United States Patent [19]

Donlon

[11] 4,061,242

[45] Dec. 6, 1977

[54] DRIPLESS PAINT CONTAINER

[76] Inventor: Joseph J. Donlon, 1240 Dauphine St., New Orleans, La. 70116

[21] Appl. No.: 713,446

[22] Filed: Aug. 11, 1976

[51] Int. Cl.[2] ..... B65D 1/36; B65D 23/08; B65D 25/28

[52] U.S. Cl. ..... 220/90; 215/100.5; 220/20; 220/94 R; 220/DIG. 5; 222/108

[58] Field of Search ..... 220/90, 94, 20, 85 H, 220/DIG. 5; 206/361, 362; 15/264, 257.05; 224/45 W; 215/100.5; 222/108

[56] References Cited

U.S. PATENT DOCUMENTS

| | | | |
|---|---|---|---|
| 160,500 | 3/1875 | Wooster | 15/264 |
| 606,100 | 6/1898 | Thompson | 220/17 |
| 898,773 | 9/1908 | McKown | 220/17 |
| 1,451,984 | 4/1923 | Jordan | 220/17 |
| 1,734,976 | 11/1929 | McClellan | 15/257.05 |
| 1,744,355 | 1/1930 | Benton | 220/17 |
| 2,669,736 | 2/1954 | Wabnitz | 220/20 |
| 3,252,613 | 5/1966 | McGrath | 220/90 |
| 3,407,429 | 10/1968 | Di Nardo | 15/257 R |
| 3,837,034 | 9/1974 | Leffert et al. | 206/362 |

*Primary Examiner*—George E. Lowrance
*Assistant Examiner*—Allan N. Shoap
*Attorney, Agent, or Firm*—Pugh & Keaty, Ltd.

[57] ABSTRACT

A specialized, reusable container for paint including an outer, bottom drip-catching body and an inner, main body for holding a supply of paint and a handle extending from the bottom section to the main, paint-containing section at and attached to the rears thereof. Included within the main, paint-containing section is a lateral, rotatable wire used to wipe the paint brush after the brush is dipped into the paint contained in the main body. Also included at the front of the bottom section is a projecting lip which defines a paint brush support in conjunction with the front wall of the inner, main body. The two sections of the container are preferably rectangular in horizontal configuration, with the inner, paint-containing section offset to the rear of the bottom, drip-catching section but still spaced therefrom to form a small gap.

9 Claims, 6 Drawing Figures

DRIPLESS PAINT CONTAINER

BACKGROUND OF THE INVENTION

1. Field of the Invention

The present invention relates to a paint container for use with manual painting by brush.

2. Discussion of the Prior Art

There have been many attempts in the prior art to provide paint containing and drip-catching means for use with a hand-held paint brush.

Typical examples of the state of the art are shown in the below listed patents:

| Patentee | Patent Number | Issue Date |
|---|---|---|
| F. H. Shevalier | 1,293,951 | Feb. 11, 1919 |
| A. E. Myers | 2,355,549 | Aug. 8, 1944 |
| M. L. Worthington | 2,518,214 | Aug. 8, 1950 |
| J. T. Kenney | 2,709,540 | May 31, 1955 |
| L. A. Di Nardo | 3,407,429 | Oct. 29, 1968 |
| J. P. Kulbacki | 3,593,880 | July 20, 1971 |
| D. C. Brown | 3,688,943 | Sept. 5, 1972 |

The Shevalier patent ('951) discloses a renewable paint cup and scraper including a handle integrally associated therewith.

The Worthington ('214) and Kenney ('540) patents also disclose handles for attaching to the standard paint can.

The Worthington ('214) and Di Nardo ('429) patents are examples of apron accessories for the attachment to the bottom of the standard paint cans to catch any paint drippings. The Brown ('943) patent in its embodiment of FIG. 6 shows a multi-compartmented bottom section for attaching to the bottom of a paint can, the compartments of which can be used to retain a number of painting implements, including brushes.

The Myers ('549) and Kulbacki ('880) patents are cited as typical examples of the prior art showing a wire structure across a paint can opening to serve as a brush wiper construction.

However, although individual aspects of the present invention may be considered previously known, it is believed that the present invention provides a most improved combined paint container and drip collector with handle and other features far superior and more advantageous than the various structures disclosed in the prior art.

GENERAL DISCUSSION OF THE PRESENT INVENTION

The preferred embodiment of the reusable drip-catching paint container of the present invention includes two similar, rectangular sections with a rear handle, the inner section serving as the paint container and the outer section serving to catch any drippings, the front space between the two also serving as a temporary storage support for the paint brush. The inner paint-containing section also includes a rotatable brush scraping wire.

The present invention is a simple, economical and easy to use, is aesthetic in appearance, and very practical in use.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 2 is a rear, perspective view of the preferred embodiment of FIG. 1; while

DETAILED DESCRIPTION OF THE PREFERRED EMBODIMENT

Figure 3:
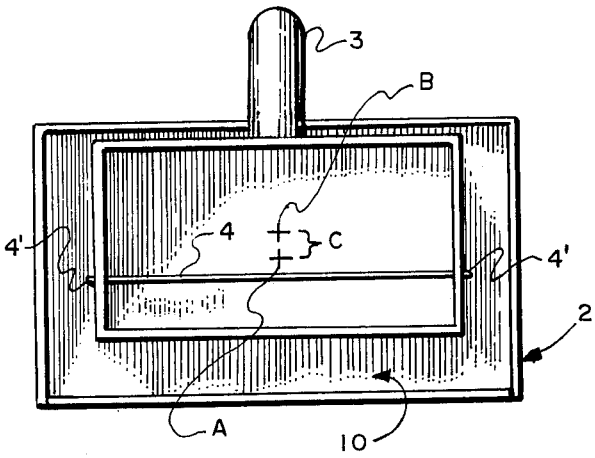
FIG. 3 is a plan view of the preferred embodiment of FIGS. 1 and 2.

As illustrated in the drawings, the preferred embodiment of the reusable paint container of the present invention includes an inner, rectangular, paint-containing main body 1 with an open top with an outer, lower, paint drip-catching body 2. The main body 1 sits within and is connected through its bottom to the lower body 2, and, as best seen in FIG. 3, the main body is offset towards the rear of the rectangular lower body 2 by a distance "C", points "A" and "B" representing the horizontal center points of the rectangular bodies 2 and 1, respectively. However, a relatively small gap 6 between the rear sides of the body sections 1, 2 remains to catch any paint drippings coming down the rear side 7.

The lower body 2 and the paint-containing body 1 are also connected together by means of a vertical handle 3, which is basically "C"-shaped and has a circular cross-section for easy gripping and holding. The rectangular configuration of the body sections 1, 2 have their longer dimensions toward the sides with respect to the handle 3, rather than frontally to better distribute the weight.

Figure 2:
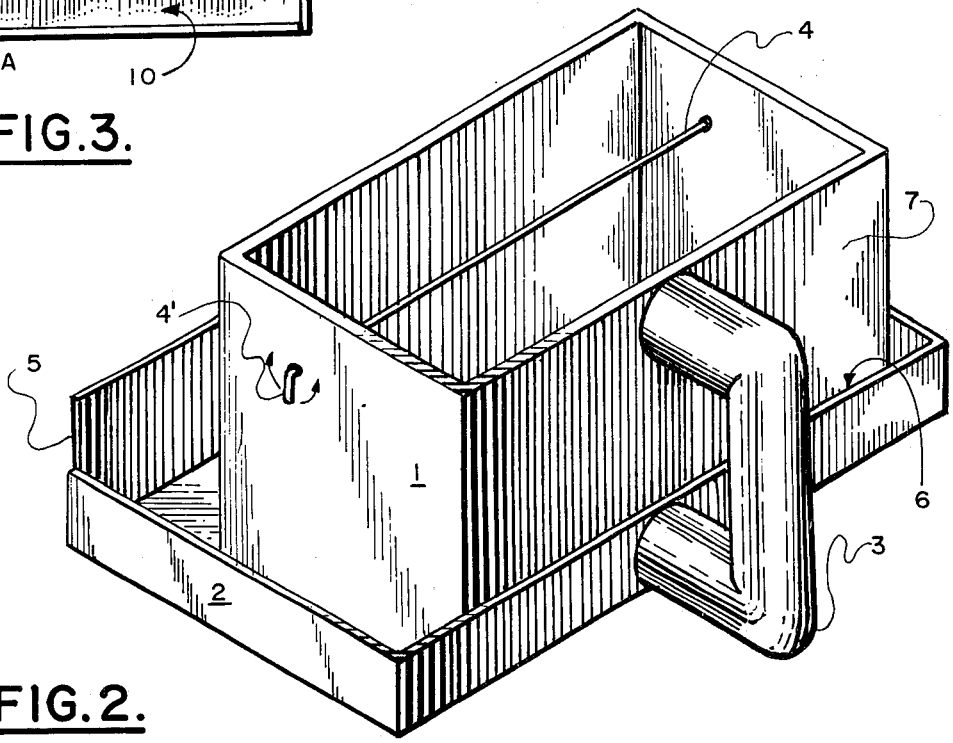
Figure 4:
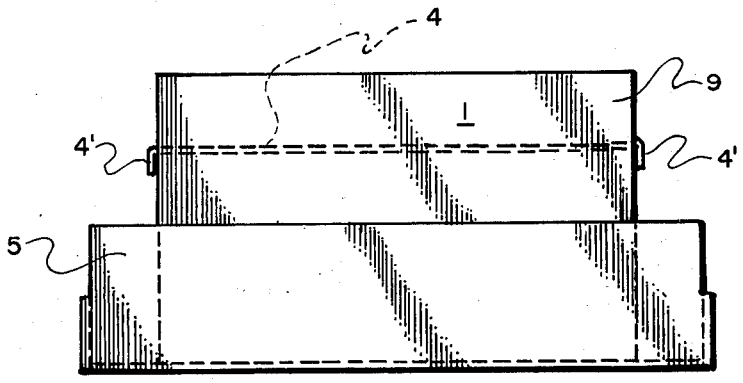
FIGS. 4, 5 and 6 are front, side and rear views, respectively, of the preferred embodiment of FIG. 1.

Located and suspended across the side walls of the paint-containing body 1 is a wire brush scraper 4 having down-turned ends 4', keeping it within the holes or openings in the side walls of the paint container 1. The wire scraper 4 is free to rotate within the openings in the side walls and the down-turned ends 4' allow easy manipulating of the wire scraper for rotational movement of the wire scraper about its longitudinal axes (note directional arrows in FIG. 2).

Figure 1:
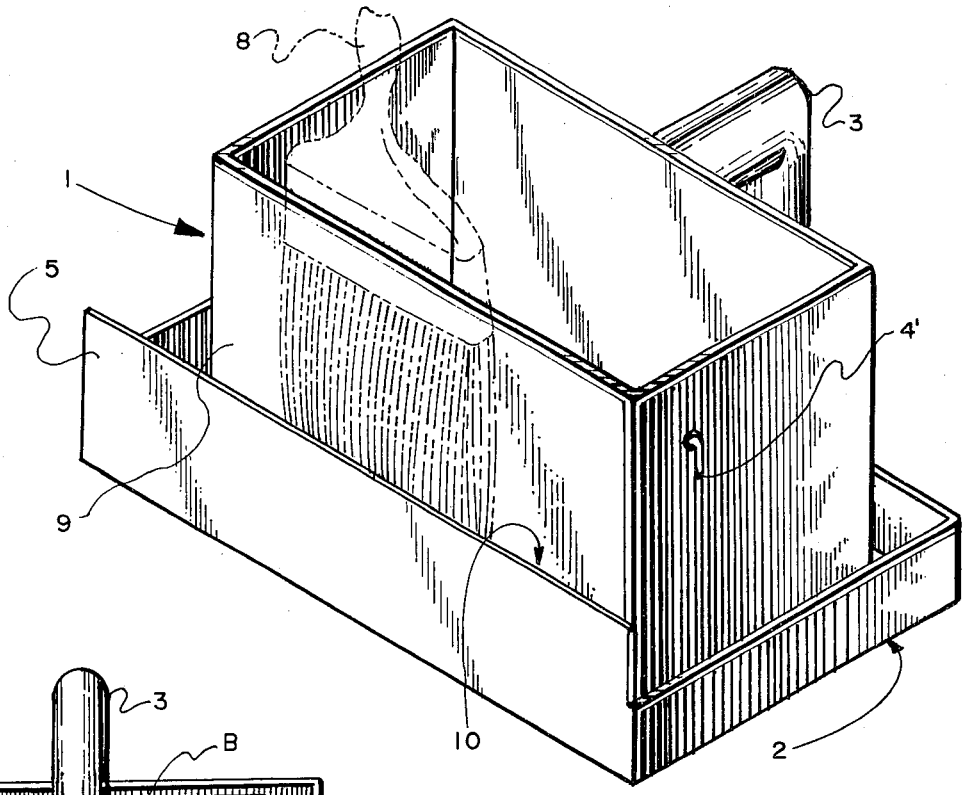
FIG. 1 is a front, perspective view of the preferred embodiment of the present invention.
Figure 5:
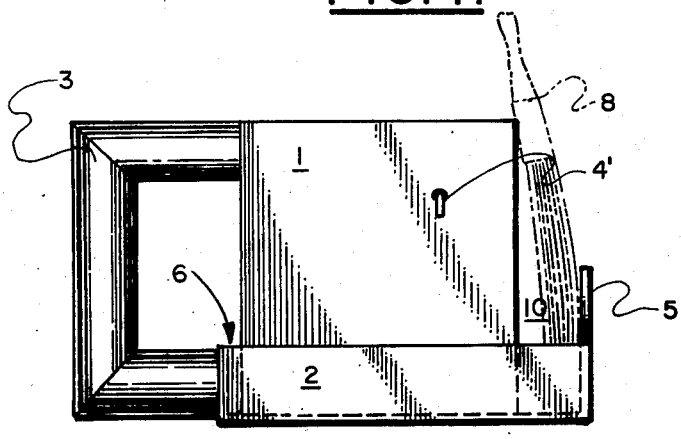
Figure 6:
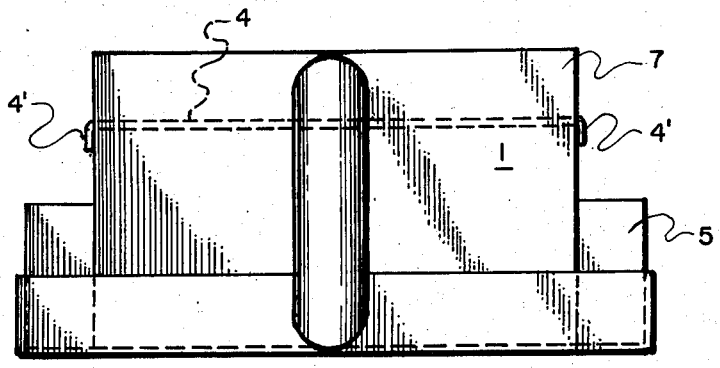

Each body section 1, 2 is comprised of a bottom and four side walls. However, the front side wall of the lower body section 2 includes a vertical, projecting lip 5 extending above the other three side walls. As seen in phantom line in FIGS. 1 and 5, the lip 5 allows a paint brush 8 to be securely supported between the lip 5 and the front side 9 of the body section 1.

In use, paint is poured into the main, paint-containing body 1 to a point below the wire scraper 4. After the paint brush is dipped into the container 1, the excess paint on the brush is removed by scraping the brush up along and across the rotatable wire 4. Alternatively, the excess paint can be scraped off on the top edges of the sides of the body section 1, with any dripping therefrom on the exterior of the body 1 being caught within the confines of the lower body section 2. While painting, the container 1, 2 can be kept readily and conveniently available to the painter by holding it in close proximity with handle 3 in the painter's other hand. When it is desired to set the container 1, 2 down, the brush 8 can be set in the front gap 10 between the lip 5 and the inner, front wall 9 for temporary, vertical storage.

Liners (not illustrated) of for example plastic sheet construction can be inserted and used in the paint container 1, as well as in the lower body section 2, for ease in cleaning the device 1 after use. Thus, after use, the liners can be removed and discarded leaving a clean device 1.

Typical dimensions for the preferred embodiment of the "dripless" container are set out below:

outer overflow section (2) — 5 W × 8 L × 1 H
front facing member of outer section (5) — 2 H
paint containing section (1) — 3½ W × 6 L × 4 H
wipe off rod (4) — 6⅝ L × 1/16 Dia.

The basic container parts 1, 2, 3 are preferably made of strong, lightweight and easily cleanable materials which will not be chemically attacked by paint cleaning solvents.

Although the above described details are considered most preferred, many variations thereof are of course possible. For example, the sides of the outer body section 2 could also be extended upwardly to provide additional brush support areas. Also one or both of the body sections could be circular rather than rectangular, although the latter is considered most preferable and important.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. A dripless paint container, comprising:

a. a rectangular drip catching pan having a closed bottom and sidewalls; and b. rectangular holding means for holding paint having a closed bottom and side walls, said holding means being, mounted within said drip catching pan, the side walls of said holding means spaced from the side walls of said drip catching pan, the central and vertical, longitudinal axis of said holding means offset from but parallel to the central and vertical, longitudinal axis of said drip catching pan, said holding means having horizontal cross-sectional dimensions smaller than the cross-sectional dimensions of said drip catching pan, said drip catching pan providing an offset drip catching surface completely surrounding said holding means.

2. The apparatus as defined in claim 1 wherein the side wall of said drip catching pan adjacent said offset portion is higher than the other three side walls of said drip catching pan.

3. The apparatus as defined in claim 2, wherein said offset portion with the higher side wall comprises storage means for holding a wet paint brush.

4. The apparatus as defined in claim 1, wherein said holding means has horizontally disposed wire means for wiping off a wet paint brush.

5. The apparatus as defined in claim 1, wherein said drip catching pan has a square bottom and four side walls.

6. The apparatus as defined in claim 5, wherein said holding means has a square bottom and four side walls.

7. The apparatus as defined in claim 1, wherein there is further included handle means for carrying said dripless paint can.

8. The apparatus as defined in claim 7, wherein said handle means comprises a U-shaped handle, vertically disposed, with its end portions rigidly affixed to said drip pan and to said holding means respectively.

9. A dripless paint container comprising:

a. an outer drip catching pan, said pan having a bottom portion and four side walls, one of said side walls higher than the remainder of said side walls;

b. an inner paint holding means having a bottom portion and four side walls, said paint holding means having a bottom portion with smaller dimensions than the dimensions of the bottom portion of said drip catching pan, the bottom portion of said paint holding means rigidly mounted to the bottom portion of said drip catching pan with the central and vertical, longitudinal axis of said paint holding means offset from the central and vertical, longitudinal axis of said drip catching pan in a direction away from the higher wall of said drip catching pan;

c. an elongated substantially horizontal wire rotatably connected to two opposite respective walls of said paint holding means near the top portion thereof; and d. a U-shaped handle, vertically, rigidly affixed at its respective ends to a side wall of said drip pan and to an adjacent side wall of said paint holding means.

* * * * *